US007048875B2

(12) United States Patent
Oommen et al.

(10) Patent No.: US 7,048,875 B2
(45) Date of Patent: May 23, 2006

(54) HIGH OLEIC ACID OIL COMPOSITIONS AND METHODS OF MAKING AND ELECTRICAL INSULATION FLUIDS AND DEVICES COMPRISING THE SAME

(75) Inventors: Thottathil V. Oommen, Raleigh, NC (US); C. Clair Claiborne, Apex, NC (US)

(73) Assignee: ABB Technology AG, Zurich (CH)

( * ) Notice: Subject to any disclaimer, the term of this patent is extended or adjusted under 35 U.S.C. 154(b) by 0 days.

(21) Appl. No.: 10/663,089

(22) Filed: Sep. 15, 2003

(65) Prior Publication Data

US 2004/0089855 A1 May 13, 2004

Related U.S. Application Data

(63) Continuation of application No. 09/928,000, filed on Aug. 10, 2001, now Pat. No. 6,645,404, which is a continuation of application No. 09/321,653, filed on May 28, 1999, now Pat. No. 6,274,067, which is a continuation of application No. 08/778,608, filed on Jan. 6, 1997, now Pat. No. 5,949,017, which is a continuation-in-part of application No. 08/665,721, filed on Jun. 18, 1996, now abandoned.

(51) Int. Cl.
*H01B 3/20* (2006.01)

(52) U.S. Cl. ..... 252/579; 252/73; 252/75; 252/79; 252/578; 252/365

(58) Field of Classification Search ..... 252/579, 252/73, 75, 79, 578, 365
See application file for complete search history.

(56) References Cited

U.S. PATENT DOCUMENTS

| | | | | |
|---|---|---|---|---|
| 1,935,595 | A | 11/1933 | Clark | |
| 2,012,302 | A | 8/1935 | Clark et al. | 260/64 |
| 2,369,090 | A | 2/1945 | Trautman | 174/17 |
| 3,702,895 | A | 11/1972 | De Sio | |
| 3,894,959 | A | 7/1975 | Gardiner et al. | 252/69 |
| 4,082,866 | A | 4/1978 | Link | 427/294 |
| 4,108,789 | A | 8/1978 | Jay et al. | 252/64 |
| 4,126,844 | A | 11/1978 | Hollister et al. | 336/198 |
| 4,142,983 | A | 3/1979 | Jay et al. | 252/64 |
| 4,206,066 | A | 6/1980 | Rinehart | 252/63.2 |
| 4,307,364 | A | 12/1981 | Lanoue et al. | 336/60 |
| 4,355,346 | A | 10/1982 | Gauger et al. | |
| 4,388,669 | A | 6/1983 | Cichanowski | |
| 4,536,331 | A | 8/1985 | Shedigian | 252/579 |
| 4,538,208 | A | 8/1985 | Shedigian | |
| 4,621,302 | A | 11/1986 | Sato et al. | 361/315 |
| 4,623,953 | A | 11/1986 | Dakin | 361/315 |
| 4,627,192 | A | 12/1986 | Fick | 47/58 |
| 4,642,730 | A | 2/1987 | Sato et al. | 361/315 |
| 4,681,980 | A | 7/1987 | Sato et al. | |
| 4,734,824 | A | 3/1988 | Sato et al. | |
| 4,743,402 | A | 5/1988 | Fick | 260/412.2 |
| 4,806,276 | A | 2/1989 | Maier | 252/570 |
| 4,812,262 | A | 3/1989 | Shinzawa et al. | 252/567 |
| 4,890,086 | A | 12/1989 | Hill | 336/210 |
| 4,972,168 | A | 11/1990 | Grimes et al. | 336/213 |
| 4,993,141 | A | 2/1991 | Grimes et al. | 29/606 |
| 5,017,733 | A | 5/1991 | Sato et al. | 585/6.3 |
| 5,025,949 | A | 6/1991 | Adkins et al. | 220/481 |
| 5,077,069 | A | 12/1991 | Chang et al. | |
| 5,102,659 | A | 4/1992 | Hudson | |
| 5,200,214 | A | 4/1993 | Barkalow et al. | |
| 5,250,750 | A | 10/1993 | Shubkin et al. | 174/17 |
| 5,260,077 | A | 11/1993 | Carrick et al. | 426/73 |
| 5,328,619 | A | 7/1994 | Conary | |
| 5,336,423 | A | 8/1994 | Pialet et al. | 252/76 |
| 5,336,847 | A | 8/1994 | Nakagami | 174/17 |
| 5,399,275 | A | 3/1995 | Lange et al. | 252/49.008 |
| 5,413,725 | A | 5/1995 | Lal et al. | 508/280 |
| 5,429,761 | A | 7/1995 | Havelka et al. | 252/74 |
| 5,538,654 | A | 7/1996 | Lawate et al. | 508/308 |
| 5,580,482 | A | 12/1996 | Chasan et al. | 508/243 |
| 5,658,864 | A | 8/1997 | Macpherson | |

(Continued)

FOREIGN PATENT DOCUMENTS

CA 2 204 273 11/1998

(Continued)

OTHER PUBLICATIONS

Brochure, "Sustane Food-Grade Antioxidants" UOP, Foo Products and Processes, 1994.Brochure, "Sustane Food-Grade Antioxidants" UOP, Food Products and Processes, 1994.

Sundin et al., "Fluid Choices in Retrofilling PCB Transformers," IEEE International Symposium on Electrical Insulation, Jun. 7-10, 1992.

Keshavamurthy et al., "Rape Seed Oil Derivative As A New Capacitor Impregnant," IEEE International Symposium on Elrical Insulation, Jun. 5-8, 1994.

(Continued)

*Primary Examiner*—Brian P. Mruk
(74) *Attorney, Agent, or Firm*—Paul R. Katterle

(57) ABSTRACT

High oleic acid triglyceride compositions that comprise fatty acid components of at least 75% oleic acid, less than 10% diunsaturated fatty acid component; less than 3% triunsaturated fatty acid component; and less than 8% saturated fatty acid component; and having the properties of a dielectric strength of at least 35 KV/100 mil gap, a dissipation factor of less than 0.05% at 25NC, acidity of less than 0.03 mg KOH/g, electrical conductivity of less than 1 pS/m at 25NC, a flash point of at least 250NC and a pour point of at least −15NC are disclosed. Electrical insulation fluids comprising the triglyceride composition are disclosed. Electrical insulation fluids that comprise the triglyceride composition and a combination of additives are disclosed. Electrical apparatuses comprising the electrical insulation fluids and the use of electrical insulation fluids to provide insulation in electrical apparatuses are disclosed. A process for preparing the high oleic acid triglyceride composition is disclosed.

19 Claims, No Drawings

U.S. PATENT DOCUMENTS

| | | | | |
|---|---|---|---|---|
| 5,736,915 | A | 4/1998 | Goedde et al. | 336/55 |
| 5,766,517 | A | 6/1998 | Goedde et al. | 252/570 |
| 5,863,872 | A | 1/1999 | Graimer | 508/491 |
| 5,912,215 | A | 6/1999 | Sapienza et al. | |
| 5,949,017 | A | 9/1999 | Oommen et al. | 174/17 |
| 5,958,851 | A | 9/1999 | Cannon et al. | 508/491 |
| 5,990,055 | A | 11/1999 | Garmier | 508/491 |
| 6,037,537 | A | 3/2000 | McShane et al. | 174/17 |
| 6,184,459 | B1 | 2/2001 | McShane et al. | 174/17 |
| 6,280,659 | B1 | 8/2001 | Sundin | |
| 6,352,655 | B1 | 3/2002 | McShane et al. | 252/579 |
| 6,398,986 | B1 | 6/2002 | McShane et al. | 252/579 |

FOREIGN PATENT DOCUMENTS

| | | |
|---|---|---|
| GB | 582281 | 11/1946 |
| GB | 835078 | 5/1960 |
| JP | 52-25298 | 8/1975 |
| JP | 52-272298 | 8/1975 |
| JP | 52-25298 | 2/1977 |
| JP | 54-003106 | 1/1979 |
| JP | 61042816 | 3/1986 |
| JP | 156604 | 7/1986 |
| JP | 156605 | 7/1986 |
| JP | 260503 | 11/1986 |
| WO | WO 97/22572 | 12/1996 |
| WO | WO 97/49100 | 6/1997 |

OTHER PUBLICATIONS

CIBA, [Additives Division, Ciba-Geigy Corporation, Tarrytown, NY] Product Information, Data Notes, Issue No. 12, Revised Mar. 1996.

CIBA, [Additives Division, Ciba-Geigy Corporation, Tarrytown, NY] Product Information, Data Notes, Issue No. 9, Revised Mar. 1996.

CIBA, [Additives Division, Ciba-Geigy Corporation, Tarrytown, NY] Product Information, Data Notes, Issue No. 6, Aug. 1982.

CIBA, [Additives Division, Ciba-Geigy Corporation, Tarrytown, NY] Product Information, Data Notes, Issue No. 3, Oct. 1981 CIBA,[Additives Division, Ciba-Geigy Corporation, Tarrytown, NY] Product Information, Data Notes, Issue No. 3, Oct., 1981.

Marinho, A., Jr., et al., "Castor oil as an insulating liquid," *Cigre Symposium*, 1987, *Section 5, 55-06*, 5 pages.

Moumine, I., et al., "Vegetable oil as an impregnant in HV AC capacitors," *IEEE*, 5th International Conference, 1995, 611-615.

Sundin, D., "The service history of ester-based fluids used in railway transformers," *IEEE*, International Symposium, 1990, 31-34.

Annual Book of ASTM Standards, vol. 5 and 10, American Society for Testing Materials, 100 Barr Harbor Drive West, Conshohocken, PA 19428.

Bailey's Industrial Oil and Fat Products, vols. 1, 2, & 3, 4th Ed., 1979, John Wiley & Sons.

Patterson, H.B.W., "Bleaching and purifying fats and oils," *AOCC Press*, 1992.

Nishikawa, S., et al., "Electric insulating oils," Jpn. Kokai Tokkyo Koho JP 61,156,604 [86,156,604]Jul. 16, 1986, U.S. Appl. No. 84/279,047, Dec. 27, 1984, *Chemical Abstracts 105: 175723b*, Nov. 17, 1986, 105(20), p. 190.

Nishikawa, S., "Electric insulating oils," Jpn. Kokai Tokkyo Koho JP 61,156,605 [86,156,605] Jul. 16, 1986, U.S. Appl. No. 84/279,046, Dec. 27, 1984, *Chemical Abstracts 105: 194323n*, Dec. 1, 1986, 105(22), p. 195.

Nishikawa, S., "Oil insulators for electric apparatus," Jpn. Kokai Tokkyo Koho JP 61,260,503 [86,260,503], Nov. 18, 1986, U.S. Appl. No. 85/103,288, May 14, 1985, *Chemical Abstracts 106: 112361g*, Apr. 6, 1987, 106(14), p. 683.

Nishikawa, S., "Oil containing alkyl methacrylate polymers for electric equipment," Jpn. Kokai Tokkyo Koho JP 63 24,501 [88 24, 501], Feb. 1, 1988, U.S. Appl. No. 86/168,570, Jul. 16, 1986, *Chemical Abstracts 109: 15803g*, Jul. 11, 1988, 109(2), p. 631.

Boki, K. et al., "Bleaching Rapseed and Soybean Oils with Synthetic Adsorbents and Attapulgites", *Journal of American Oil Chemist Society*(*JAOCS*), 1994, 71(6), 595-601.

Final Decision by California EPA to certify Cooper Envirotemp FR3 Dielectric Fluid Jan. 8, 2003.

Final Decision by California EPA to certify ABB BIOTEMP Dielectric Fluid Jul. 24, 2002.

Lance R. Lewand, Laboratory Evaluation of Several Synthetic and Agricultural-Based Dielectric Liquids, Doble Engineering Company, USA.

HIGH OLEIC ACID OIL COMPOSITIONS AND METHODS OF MAKING AND ELECTRICAL INSULATION FLUIDS AND DEVICES COMPRISING THE SAME

CROSS REFERENCE TO RELATED APPLICATIONS

This application is a continuation of U.S. application Ser. No. 09/928,000, filed Aug. 10, 2001; (now U.S. Patent No. 6,645,404); which is a continuation of U.S. application Ser. No. 09/321,653, filed May 28, 1999, (now U.S. Pat. No. 6,274,067); which is a continuation of U.S. application Ser. No. 08/778,608; filed Jan. 6, 1997, (now U.S. Pat. No. 5,949,017); which is a continuation-in-part of U.S. application Ser. No. 08/665,721, filed Jun. 18, 1996, now abandoned, all of which are incorporated by reference in their entirety herein.

FIELD OF THE INVENTION

The invention relates to a high oleic oil composition useful as an electrical insulation fluid, to electrical insulation fluid compositions and electrical apparatuses which comprise the same. The high oleic oil compositions of the invention have electrical properties which make them well suited as insulation fluids in electrical components.

BACKGROUND OF THE INVENTION

The electrical industry uses a variety of insulating fluids which are easily available and cost effective. Examples are mineral oil, silicone fluid, and synthetic hydrocarbon oils used in transformers, power cables and capacitors. Examples of such fluids include those described in U.S. Pat. No. 4,082,866 issued Apr. 4, 1978 to Link, U.S. Pat. No. 4,206,066 issued Jun. 3, 1980 to Rinehart, U.S. Pat. No. 4,621,302 issued Nov. 4, 1986 to Sato et al., U.S. Pat. No. 5,017,733 issued May 21, 1991 to Sato et al. U.S. Pat. No. 5,250,750 issued Oct. 5, 1993 to Shubkin et al., and U.S. Pat. No. 5,336,847 issued Aug. 9, 1994 to Nakagami, which are each incorporated herein by reference.

Many of these fluids are not considered to be biodegradable in a reasonable time frame. Some have electrical properties which render them less than optimal. In recent years regulatory agencies have become increasingly concerned about oil spills which can contaminate the ground soil and other areas. A biodegradable oil would be desirable for electrical apparatus such as transformers used in populated areas and shopping centers.

Vegetable oils are fully biodegradable, but the oils presently available in the market are not electrical grade. A few vegetable oils such as rapeseed oil and castor oil have been used in limited quantities, mostly in capacitors, but these are not oleic esters.

There is a need for a fully biodegradable electrical fluid. There is a need for electrical apparatuses which comprise such an oil. There is a need for a method of processing vegetable oil to electrical grade.

SUMMARY OF THE INVENTION

The present invention relates to high oleic acid triglyceride compositions that comprise fatty acid components of at least 75% oleic acid, less than 10% diunsaturated fatty acid component; less than 3% triunsaturated fatty acid component; and less than 8% saturated fatty acid component; and wherein said composition is further characterized by the properties of a dielectric strength of at least 35 KV/100 mil (2.5 mm) gap, a dissipation factor of less than 0.05% at 25NC, acidity of less than 0.03 mg KOH/g, electrical conductivity of less than 1 pS/m at 25NC, a flash point of at least 250NC and a pour point of at least −15NC.

The present invention relates to an electrical insulation fluid comprising at least 75% of a high oleic acid triglyceride composition that comprise fatty acid components of at least 75% oleic acid, less than 10% diunsaturated fatty acid component; less than 3% triunsaturated fatty acid component; and less than 8% saturated fatty acid component; and wherein said composition is further characterized by the properties of a dielectric strength of at least 35 KV/100 mil gap, a dissipation factor of less than 0.05% at 25NC, acidity of less than 0.03 mg KOH/g, electrical conductivity of less than 1 pS/m at 25NC, a flash point of at least 250NC and a pour point of at least −15NC, and one or more additive selected from the group of an antioxidant additive, a pour point depressant additive and a copper deactivator.

In some preferred embodiments the electrical insulation fluid comprises a pour point depressant additive, which in some embodiments is polymethacrylate.

In some preferred embodiments the electrical insulation fluid comprises a combination of antioxidant additives. In some preferred embodiments, the electrical insulation fluid comprises a combination of IRGANOX L-57 antioxidant and IRGANOX L-109 antioxidant.

In some preferred embodiments the electrical insulation fluid comprises a copper deactivator. In some preferred embodiments, the copper deactivator is IRGAMET-30 metal deactivator.

In some preferred embodiments that antioxidant additives and copper deactivators make up about 0.2–2.0% of electrical insulation fluid. It is preferred that the additives comprise a combination of IRGANOX L-57 antioxidant, IRGANOX L-109 antioxidant and IRGAMET-30 metal deactivator. It is preferred that the combination is provided at a ratio of about 1 part IRGANOX L-57 antioxidant to 2–4 parts IRGANOX L-109 antioxidant to about 1 part IRGAMET-30 metal deactivator.

In some preferred embodiments, the electrical insulation fluid comprises at least 94% of the high oleic acid triglyceride composition. In some preferred embodiments, the electrical insulation fluid comprises fatty acid components of: at least 75% oleic acid, less than 10% linoleic acid, less than 3% linolenic acid, less than 4% stearic acid, and less than 4% palmitic acid. In some preferred embodiments the electrical insulation fluid is characterized by the properties of: a dielectric strength of at least 40 KV/100 mil gap, a dissipation factor of less than 0.02% at 25NC, acidity of less than 0.02 mg KOH/g, electrical conductivity of less than 0.25 pS/m at 25NC, a flash point of at least 300NC, and a pour point of at least −20NC, and in some embodiments, at least −40NC. In some preferred embodiments the electrical insulation fluid comprises 0.5–1.0%, in some embodiments 0.5%, of the combination of IRGANOX L-57 antioxidant, IRGANOX L-109 antioxidant and IRGAMET-30 metal deactivator. In some preferred embodiments the combination of IRGANOX L-57 antioxidant, IRGANOX L-109 antioxidant and IRGAMET-30 metal deactivator has a ratio of about 1 part IRGANOX L-57 antioxidant to about 3 parts IRGANOX L-109 antioxidant to about 1 part IRGAMET-30 metal deactivator.

The present invention relates to electrical apparatuses comprising the electrical insulation fluid.

The present invention relates to the use of electrical insulation fluid to provide insulation in electrical apparatuses.

The present invention relates to a process for preparing the high oleic acid triglyceride composition comprising the steps of combining refined, bleached and deodorized high oleic acid triglyceride with clay to form a mixture and filtering the mixture to remove the clay.

DETAILED DESCRIPTION OF THE INVENTION

This present invention provides a novel application for high oleic vegetable oils as electrical insulation fluids. Vegetable oils usually have a high percent of triglyceride esters of saturated and unsaturated organic acids. When the acid is saturated, the triglyceride is either a semi-solid or a liquid with high freezing point. Unsaturated acids produce oils with low freezing points. However, monounsaturated acids are preferred over diunsaturated and triunsaturated acids because the latter tend to dry fast in air due to cross-linking with oxygen. Increasing the amount of diunsaturates and triunsaturates makes the oil more vulnerable to oxidation; increasing the saturates raises the pour point. Ideally, the higher the monosaturate content, the better the oil as an electrical fluid.

Oleic acid is a monounsaturated acid found as triglyceride ester in many natural oils such as sunflower, olive oil and safflower in relatively high proportions (above 60%). High oleic acid content is usually above 75% of the total acid content. Oleic acid content above 80% is achieved by genetic manipulation and breeding. Two oils that are currently available in the United States with high oleic acid content and low saturates are sunflower oil and canola oil. These oils are of value in producing high quality lubricating oils but have not been used in the production of electrical insulation fluids.

High oleic oils may be derived from plant seeds such as sunflower and canola which have been genetically modified to yield high oleic content. The pure oils are triglycerides of certain fatty acids with a carbon chain ranging from 16 to 22 carbon atoms. If the carbon chain has no double bonds, it is a saturated oil, and is designated Cn:0 where n is the number of carbon atoms. Chains with one double bond are monounsaturated and are designated Cn:1; with two double bonds, it will be Cn:2 and with three double bonds Cn:3. Oleic acid is a C18:1 acid while erucic acid is a C22:1 acid. The acids are in the combined state as triglycerides, and when the oils are hydrolyzed they are separated into the acid and glycerol components. High oleic oils contain more than 75% oleic acid (in combined state with glycerol), the remaining being composed mainly of C18:0, C18:2 and C18:3 acids (also in combined state with glycerol). These acids are known as stearic, linoleic and linolenic. Oils with a high percentage of double and triple unsaturated molecules are unsuitable for electrical application because they react with air and produce oxidation products. Monounsaturated oils such as oleic acid esters may also react with air, but much slower, and can be stabilized with oxidation inhibitors.

A typical 85% high oleic oil has the following approximate composition:

| | |
|---|---|
| Saturates: | 3–5% |
| monounsaturates: | 84–85% |
| diunsaturates: | 3–7% |
| triunsaturates: | 1–3% |

While the present invention provides for the use of vegetable oils, the invention may use synthetic oil having the same compositional characteristics of those oils isolated from plants. While plant derived material is suitable for almost all applications, synthetic material may provide a desirable alternative in some applications.

According to the present invention, high oleic acid content oils are used as starting materials for the production of an oil composition which has physical properties useful for electrical insulation fluids. The present invention provides the processed compositions having specific structural and physical characteristics and properties, methods of making such composition, electrical insulation fluids which comprise the composition, electrical apparatuses which comprise the electrical insulation fluids and methods of insulating electrical apparatuses using such fluids.

The present invention provides a high oleic acid triglyceride composition useful as an electrical insulation fluid and more particularly as a component material of an electrical insulation fluid. A triglyceride composition is a glycerol backbone linked to three fatty acid molecules. The triglyceride compositions of the invention comprise fatty acid components of at least 75% oleic acid. The remaining fatty acid components include less than 10% diunsaturated fatty acid component, less than 3% triunsaturated fatty acid component; and less than 8% saturated fatty acid component.

The triglyceride compositions of the invention preferably comprise fatty acid components of at least 80% oleic acid. The triglyceride compositions of the invention more preferably comprise fatty acid components of at least 85% oleic acid. In some embodiments, the triglyceride compositions of the invention comprise fatty acid components of 90% oleic acid. In some embodiments, the triglyceride compositions of the invention comprise fatty acid components of greater than 90% oleic acid.

Di-unsaturated, triunsaturated and saturated fatty acid components present in the triglyceride are preferably C16–C22. It is preferred that 80% or more of the remaining fatty acid components are C18 diunsaturated, triunsaturated and saturated fatty acids, i.e. linoleic, linolenic and stearic acids, respectively. In some embodiments, the diunsaturated, triunsaturated and saturated fatty acid components of the triglyceride comprise at least 75% oleic acid, less than 3% linoleic acid, less than 4% stearic acid and less than 4% palmitic acid (saturated C16).

The triglyceride compositions of the invention are of an electric grade. That is, they have specific physical properties which make them particularly suited for use as an electrical insulation fluid. The dielectric strength of a triglyceride composition of the invention is at least 35 KV/100 mil (2.5 mm) gap, the dissipation factor is less than 0.05% at 25NC, the acidity is less than 0.03 mg KOH/g, the electrical conductivity is less than 1 pS/m at 25NC, the flash point is at least 250NC and the pour point is at least −15NC.

The dielectric strength, dissipation factor, acidity, electrical conductivity, flash point and pour point are each measured using the published standards set forth in the Annual Book of ASTM Standards (in Volumes 5 and 10) published by the American Society for Testing Materials (ASTM), 100 Barr Harbor Drive West Conshohocken Pa. 19428, which is incorporated herein by reference. The dielectric strength is determined using ASTM test method D 877. The dissipation factor is determined using ASTM test method D 924. The acidity is determined using ASTM test method D 974. The electrical conductivity is determined using ASTM test method D 2624. The flash point is determined using ASTM test method D 92. The pour point is determined using ASTM test method D 97.

The dielectric strength is measured by taking 100–150 ml oil sample in a test cell and applying a voltage between test electrodes separated by a specified gap. The breakdown voltage is noted. The test is preferably run five times and the average value is calculated. The dielectric strength of a triglyceride composition of the invention is at least 35 KV/100 mil (2.5 mm) gap. In some preferred embodiments, it is 40 KV/100 mil (2.5 mm) gap.

The dissipation factor is a measure of the electrical loss due to conducting species and is tested by measuring the capacitance of fluids in a test cell using a capacitance bridge. The dissipation factor of a triglyceride composition of the invention is less than 0.05% at 25C. In some preferred embodiments, it is less than 0.02%. In some preferred embodiments, it is less than 0.01%.

The acidity is measured by titrating a known volume of oil with a solution of alcoholic KOH to neutralization point. The weight of the oil in grams per mg KOH is referred to interchangeably as the acidity number or the neutralization number. The acidity of a triglyceride composition of the invention is less than 0.03 mg KOH/g. In some preferred embodiments, it is less than 0.02 mg KOH/g.

The electrical conductivity is measured using a conductivity meter such as an Emcee meter. The electrical conductivity of a triglyceride composition of the invention is less than 1 pS/m at 25NC. In some preferred embodiments, it is less than 0.25 pS/m.

The flash point is determined by placing an oil sample in a flashpoint tester and determining the temperature at which it ignites. The flash point of a triglyceride composition of the invention is at least 250NC. In some preferred embodiments, it is at least 300NC.

The pour point is determined by cooling an oil sample with dry ice/acetone and determining the temperature at which the liquid becomes a semi-solid. The pour point of a triglyceride composition of the invention is not greater than −15NC. In some preferred embodiments, it is not greater than −20NC. In some preferred embodiments, it is not greater than −40NC.

In some preferred embodiments, the triglyceride composition of the invention is characterized by the properties of a dielectric strength of at least 40 KV/100 mil (2.5 mm) gap, a dissipation factor of less than 0.02% at 25NC, acidity of less than 0.02 mg KOH/g, electrical conductivity of less than 0.25 pS/m at 25NC, a flash point of at least 300NC and a pour point of not greater than −20NC. In some preferred embodiments, the pour point is not greater than − 40NC.

In some preferred embodiments, the triglyceride composition of the invention comprises fatty acid components of at least 75% oleic acid, linoleic acid at a proportion of less than 10%, linoleic acid at a proportion of less than 3%, stearic acid in a proportion of less than 4%, and palmitic acid in a proportion of less than 4%, and is characterized by the properties of a dielectric strength of at least 40 KV/100 mil (2.5 mm) gap, a dissipation factor of less than 0.02% at 25NC, acidity of less than 0.02 mg KOH/g, electrical conductivity of less than 0.25 pS/m at 25NC, a flash point of at least 300NC and a pour point of not greater than −20NC. In some preferred embodiments, the pour point is not greater than −40NC.

Triglycerides with high oleic acid oil content are described in U.S. Pat. No. 4,627,192 issued Dec. 4, 1986 to Fick and U.S. Pat. No. 4,743,402 issued May 10, 1988 to Fick, which are incorporated herein by reference. These oils or those with similar fatty acid component content according to the present invention may be processed to yield an oil with the desired physical properties. High oleic vegetable oils may be obtained from commercial suppliers as RBD oils (refined, bleached and deodorized) which are further processed according to the present invention to yield high oleic oils useful in electrical insulation fluid compositions. There are several suppliers of high oleic RBD oils in the USA and overseas. RBD oil useful as a starting material for further processing may be obtained from SVO Specialty Products, Eastlake Ohio, and Cargill Corp., Minneapolis Minn. The oil manufacturer goes through an elaborate process to obtain RBD oil during which all nonoily components (gums, phospholipids, pigments etc.) are removed. Further steps may involve winterization (chilling) to remove saturates, and stabilization using nontoxic additives. The processes for converting oil to RBD oil are described in *Bailey=s Industrial Oil and Fat Products*, Vols. 1, 2 & 3, Fourth Edition 1979 John Wiley & Sons and in *Bleaching and Purifying Fats and Oils* by H. B. W. Patterson, AOCC Press, 1992, which are incorporated herein by reference.

RBD oils are further processed according to the present invention in order to yield an oil with the physical properties as defined herein. The purification of the as received oil designated RBD oil is necessary because trace polar compounds and acidic materials still remain in the oil, making it unfit as an electrical fluid. The purification process of the present invention uses clay treatment which involves essentially a bleaching process using neutral clay. RBD oil is combination with 10% by weight clay and mixed for at least about 20 minutes. It is preferred if the oil is heated to about 60–80NC. It is preferred if the mixture is agitated. The clay particles are removed subsequently by a filter press. Vacuum conditions or a neutral atmosphere (by nitrogen) during this process prevent oxidation. Slightly stabilized oil is preferable. More stabilizer is added at the end of the process. The purity is monitored by electrical conductivity, acidity and dissipation factor measurement. Further treatment by deodorization techniques is possible but not essential. The polar compounds that interfere most with electrical properties are organometallic compounds such as metallic soaps, chlorophyll pigments and so on. The level of purification needed is determined by the measured properties and the limits used. An alternative embodiment provides passing RBD oil through a clay column. However, stirring with clay removes trace polar impurities better than passing through a clay column. In preferred embodiments, neutral Attapulgite clay, typically 30/60 mesh size, is used in a ratio of 1–10% clay by weight. In some embodiments, clay particles are removed using filters, preferably paper filters with a pore size of 1–5 μm. The clay is preferably mixed with hot oil and agitated for several minutes, after which the clay is filtered off using filters. Paper or synthetic filter sheets may be used if a filter separator is used. The filter sheets are periodically replaced.

Electrical insulation fluids of the invention comprise the triglyceride composition of the invention and may further comprise one or more additives. Additives include oxidation inhibitors, copper deactivators and pour point depressors.

Oxidation inhibitors may be added to the oils. Oxidation stability is desirable but in sealed units where there is no oxygen, it should not be critical. Commonly used oxidation inhibitors include butylated hydroxy toluene (BHT), butylated hydroxy anisole (BHA) and mono-tertiary butyl hydro quinone (TBHQ). In some embodiments, oxidation inhibitors are used in combinations such as BHA and BHT. Oxidation inhibitors may be present at levels of 0.1–3.0%. In some preferred embodiments, 0.2% TBHQ is used. Oxidation stability of the oil is determined by AOM or OSI methods well known to those skilled in the art. In the AOM method, the oil is oxidized by air at 100NC and the formation of peroxide is monitored. The time to reach 100 milliequivalents (meq) or any other limit is determined. The higher the value, the more stable the oil is. In the OSI method, the time to reach an induction period is determined by the measurement of conductivity.

Since copper is always present in the electrical environment, another type of additive is copper deactivators. Copper deactivators such as benzotriazole derivatives are commercially available. The use of these in small, such as below 1%, may be beneficial in reducing the catalytic activity of copper in electrical apparatus. In some embodiments, the electrical insulation fluid contains less than 1% of a copper deactivator. In some embodiments, the copper deactivator is a benzotriazole derivative.

According to some preferred embodiments the present invention, a combination of additives set forth herein particularly is effective when used in combination with high oleic acid triglyceride compositions to form electrical insulation fluids. The additives include a combination of combination of. The combination of additives included in the electrical insulation fluid of the invention include three additives: IRGANOX L-57 antioxidant, IRGANOX L-109 antioxidant and IRGAMET-30 metal deactivator which are each commercially available from CIBA-GEIGY, Inc. (Tarrytown, N.Y.). The combination of additives is present in a combined total in the fluid at between 0.2 and 2.0%, preferably between 0.5–1.0%. In some preferred embodiments, the combination of additives is present at about 0.5%.

The combination of additives may be present in a ratio of about 1 part IRGANOX L-57 antioxidant to about 24 parts IRGANOX L-109 antioxidant to about 1 part IRGAMET-30 metal deactivator. In some preferred embodiment, the combination of additives is present in a ratio of about 1 part IRGANOX L-57 antioxidant to about 3 parts IRGANOX L-109 antioxidant to about 1 part IRGAMET-30 metal deactivator.

IRGANOX L-57 antioxidant is commercially available from CIBA/GEIGY and is a liquid mixture of alkylated diphenylamines; specifically the reaction products of reacting N-Phenylbenzenamine with 2,4,4-trimethlypentane.

IRGANOX L-109 antioxidant is commercially available from CIBA/GEIGY and is a high molecular weight phenolic antioxidant, bis(3,5-di-tert-butyl-4-hydroxyhydrocinnamate. IRGANOX L-109 antioxidant is a bis(2,6-di-tert-butylphenol derivative.

IRGAMET-30 metal deactivator metal deactivator is commercially available from CIBA/GEIGY and is a triazole derivative, N,N-bis (2-Ethylhexyl)-1H-1,2,4-triazole-1 methanamine.

IRGANOX L-57 antioxidant and IRGANOX L-109 antioxidant are antioxidants, and IRGAMET-30 metal deactivator is a copper pasivator. In electrical apparatuses, copper is widely used as conductor and copper has a catalytic effect in the oxidation of oil. The antioxidants react with free oxygen thereby preventing the latter from attacking the oil.

Pour points depressants may also be added if low pour points are needed. Commercially available products can be used which are compatible with vegetable-based oils. Only low percentages, such as 2% or below, are needed normally to bring down the pour point by 10 to 15NC. In some embodiments, the pour point depressant is polymethacrylate (PMA).

In some embodiments, the pour point may be further reduced by winterizing processed oil. Essentially, the oils are winterized by lowering the temperature to near or below ONC and removing solidified components. The winterization process may be performed as a series of temperature reductions followed by removal of solids at the various temperature. In some embodiments, winterization is performed by reducing the temperature serially to 5N, 0N and −12NC for several hours, and filtering the solids with diatomaceous earth.

In some embodiments, the electrical insulation fluid of the invention that comprises at least 75 percent triglyceride composition of the invention as described above further comprises about 0.1–5% additives and then up to about 25% other insulating fluids such as mineral oil, synthetic esters, and synthetic hydrocarbons. In some embodiments, the electrical insulation fluid comprises 1–24% of insulating fluids selected from the group consisting of mineral oil, synthetic esters, synthetic hydrocarbons and combination of two or more of such materials. In some embodiments, the electrical insulation fluid comprises 5–15% of insulating fluids selected from the group consisting of mineral oil, synthetic esters, synthetic hydrocarbons and combination of two or more of such materials. Examples of mineral oils include poly alpha olefins. An example of a mineral oil which may be used as part of the present invention is RTEemp, Cooper Power Fluid Systems. Examples of synthetic esters include polyol esters. Commercially available synthetic esters which can be used as part of the invention include those sold under the trade names MIDEL 7131 (The Micanite and Insulators Co., Manchester UK), REOLEC 138 (FMC, Manchester, UK) and ENVIROTEMP 200(Cooper Power Fluid Systems). In some preferred embodiments, the electrical insulation fluid comprises at least 85% of the triglyceride composition of the invention. In some preferred embodiments, the electrical insulation fluid comprises at least 95% of the triglyceride composition of the invention.

According to some preferred embodiments of the present invention, high oleic acid content oils are used as starting materials for the production of an oil composition which has physical properties useful for electrical insulation fluids. The high oleic acid content oils are combined with a preferred combination of antioxidant and metal deactivating additives to provide electrical insulation fluids. Some preferred embodiments of the present invention relates to such electrical insulation fluids, to electrical apparatuses which comprise the electrical insulation fluids and methods of insulating electrical apparatuses using such fluids.

In some embodiments, the electrical insulation fluid of the invention that comprises at least 75 percent triglyceride composition of the invention as described above further comprises about 0.1–5% additives, including preferably 0.5–2.0% combination of IRGANOX L57 antioxidant, IRGANOX L-109 antioxidant and IRGAMET-30 metal deactivator, and then up to about 24.5% other insulating fluids such as mineral oil, synthetic esters, and synthetic hydrocarbons. In some embodiments, the electrical insulation fluid comprises 1–24% of insulating fluids selected from the group consisting of mineral oil, synthetic esters, synthetic hydrocarbons and combination of two or more of such materials. In some embodiments, the electrical insulation fluid comprises 3–20% of insulating fluids selected from the group consisting of mineral oil, synthetic esters, synthetic hydrocarbons and combination of two or more of such materials. In some embodiments, the electrical insulation fluid comprises 5–15% of insulating fluids selected from the group consisting of mineral oil, synthetic esters, synthetic hydrocarbons and combination of two or more of such materials.

The present invention relates to an electrical apparatus which comprises the electrical insulation fluid of the invention. The electrical apparatus may be an electrical transformer, an electrical capacitor or an electrical power cable. U.S. Pat. No. 4,082,866, U.S. Pat. No. 4,206,066, U.S. Pat. No. 4,621,302, U.S. Pat. No. 5,017,733, U.S. Pat. No. 5,250,750, and U.S. Pat. No. 5,336,847, which are referred to above and incorporated herein by reference describe various applications of electrical insulation fluids for which the electrical insulation fluid of the invention may be used. In addition, U.S. Pat. No. 4,993,141 issued Feb. 19, 1991 to Grimes et al., U.S. Pat. No. 4,890,086 issued Dec. 26, 1989 to Hill, U.S. Pat. No. 5,025,949 issued Jun. 25, 1991 to Adkins et al., U.S. Pat. No. 4,972,168 issued Nov. 20, 1990 to Grimes et al., U.S. Pat. No. 4,126,844, and U.S. Pat. No. 4,307,364 issued Dec. 22, 1981 to Lanoue et al., which are each hereby incorporated herein by reference contain descriptions of various electrical apparatuses in which the electrical insulation fluid of the invention may be used. In some preferred embodiments, the electrical apparatus of the invention is a transformer, in particular, a power transformer or a distribution transformer.

EXAMPLES

Example 1

Several high oleic oils were further purified and stabilized according to the present invention to make them electrically suitable. Electrical tests showed that such purified oils had properties similar to currently used high temperature fluids in distribution transformers. Table 1 compares the properties of the purified oils of the present invention with currently used fluids.

TABLE 1

Comparison of Purified Vegetable Oils with High Temperature Fluids Used in Transformers

| | High Oleic Veg. Oil | High Temp. Mineral Oil[a] | Synthetic Ester Fluid[b] |
|---|---|---|---|
| Dielectric Strength, KV/100 mil gap | 42.4 | 40–45 | 50 |
| Dissipation Factor, % at 25 NC | 0.02 | 0.01 | 0.1 |
| Neutr. No. mg KOH/g | 0.05 | — | 0.03 |
| Electrical Conductivity pS/m, 25 NC | 0.25–1.0 | (0.1 o 10)* | (5.0)* |
| Flash Point | 328 NC | 275–300 NC | 257 NC |
| Pour Point | −28 NC | −24 NC | −48 N |

[a]RTEemp, Cooper Power Fluid Systems
[b]Polyol Esters (such as MIDEL 7131 and REOLEC 138) deduced from resistivity
The properties listed for the high oleic oil are for purified oils with no additives.

Example 2

The purification of the as received oil designated RBD oil (refined, bleached and deodorized) is necessary because trace polar compounds and acidic materials still remain in the oil, making it unfit as an electrical fluid. The purification we attempted involved clay treatment as follows: approximately 1 gal. of the RBD oil was treated with 10% Attapulgite clay. Oil was produced with electrical conductivity of less than 1 pS/m. The attapulgite treated oil showed conductivities as low as 0.25 pS/m. Commercial grade oils had conductivities in the range of 1.5 to 125 pS/m. Conductivity below 1 pS/m (or resistivity above $10^{14}$ ohm.cm) is desired for electrical grade oil. Other indicators of purity are dissipation factor and neutralization number (acid number). Dissipation factor is a measure of electrical losses due to conduction caused by conducting species, usually organometallic trace components, and should be below 0.05% at room temperature. The clay treated oils had dissipation factor of 0.02%. Untreated RBD oils had DF ranging from 0.06% to 2.0%. With a finer grade of clay, the same results could be achieved with only 2% of clay. A filter separator was preferred to a filter column.

Example 3

Oxidation stability tests were conducted on treated and untreated oil samples using ASTM and AOCS methods. The untreated and treated RBD oils failed the tests. Oxidation inhibitors were added to the oils and the tests were repeated. Several oxidation inhibitors were tested: BHT (Butylated Hydroxy Toluene, BHA (Butylated Hydroxy Anisole) and TBHQ (mono-Tertiary Butyl Hydro Quinone) in 0.2% by weight in oil. In the AOCS method used (Cd 12.57) 100 ml samples are bubbled with air at 100C, and the peroxide formation was measured at several time intervals. Hours to reach 100 meq of peroxide were noted. Since copper is always present in the electrical environment, all oil samples had copper wire placed in them. With no additive, the time to reach the limit was 18 hours; with additive (0.2%), the times were 100 hours for BHT+BHA. With TBHQ, even after 400 hours, the peroxide value reached only 8.4 meq. TBHQ proved to be the best antioxidant of the three. Without an oxidation inhibitor the oils upon oxidation would produce hydroperoxide which is then converted to acids, alcohols, esters, aldehydes, ketones and polymer structures. Most electrical apparatus that use a fluid insulation operate in low oxygen or oxygen-free environment, so the concern over oxidation is not great.

Example 4

The pour point of the treated oil was typically −25NC. To lower the pour point further, the treated oils were winterized at 5N, 0N and −12NC for several hours, and the solids that separated were filtered with diatomaceous earth. The lowest pour point reached so far was −38NC, close to the specified value of −40NC for transformer oil. Further lowering is possible by extended winterization. Another approach is by the use of pour point depressants such as PMA (polymethacrylate) which has been used for mineral oil.

Example 5

A laboratory oxidation stability test was conducted using the OSI (Oil Stability Index) Method, AOCS Cd 12b-92. The additives were used in a 1:3:1 ratio at several concentrations in both the high oleic vegetable oil and in regular mineral oil used in transformers. In the OSI method, 50 ml of the oil is taken in a conductivity cell, and is placed in a bath kept at 110$^N$C. Air is bubbled through it at 2.5 ml/min. The effluent air containing the volatile fatty acids is passed through a vessel containing deionized water. The conductivity of the water is monitored as a function of time. When the antioxidant is consumed, a sudden rise in conductivity is observed. This taken as the end point. The number of hours is noted as the OSI value at 110$^N$C. It is usual to convert these values to a 97.8$^N$C OSI value to correspond to the temperature used in another oil stability test, the AOM (Active Oxygen Method), A.O.C.S Cd 12–57.

Table 2 summarizes the test results:

TABLE 2

OSI Values in Hours for Various Oils

| | OSI, 110$^N$ C. | OSI, 97.8$^N$ C. | AOM, 97.8$^N$ C. |
|---|---|---|---|
| High Oleic Veg. oil with Cu | 1.3 | 3.0 | 3.1 |
| Same, with 0.2% TBHQ | 13.5 | 31.3 | 32.6 |
| Same, with 0.2% CIBA | 79.7 | 185.2 | 192.8 |
| Same, with 0.5% CIBA | 226 | 526 | 548 |
| Transformer oil (mineral oil) + Cu | 162 | 377 | 392 |
| High Temp. Mineral Oil + Cu | 137 | 315 | 328 |

Compositions which comprise the additives at 0.5% concentration in oil is as effective as regular transformer oil, and more effective that the high temperature mineral oil used in some transformers. Another superiority of the combination of additives is that the oil conductivity at 0.5% concentration below 2 pS/m, compared to 4.5 pS/m for oil with 0.2% TBHQ.

EXAMPLE 6

Mixing the composition with other fluids can result in the lowering of pour point. For example, the electrical insulation fluid was mixed with regular mineral oil (pour point of −50$^N$C or below) and at a 5% concentration in the mixture (i.e. final electrical insulator fluid includes 5% mineral oil), the pour point was reduced to −40$^N$C. In another embodiment, the electrical insulation fluid was mixed with the synthetic ester Reolec 138 and at a 10% concentration in the mixture (i.e. final electrical insulator fluid includes 10% synthetic ester), the pour point was lowered to −42$^N$C. The above fluid may, for example, be mixed with regular mineral oil.

What is claimed is:

1. A dielectric fluid for an electrical device, said dielectric fluid comprising:

at least 75% of a high oleic acid triglyceride composition comprising fatty acid components of at least 75% oleic acid;

0.1 to 3% antioxidant additives comprising:

an alkylated diphenylamine; and one or more antioxidant compounds selected from the group consisting of butylated hydroxy toluene (BHT), butylated hydroxtanisole (BHA), mono-tertiary butyl hydraquinone (TBHQ) and combinations thereof; and wherein said triglyceride composition is further characterized by the properties of;

a dielectric strength of at least 35 KV/100 mil gap, a dissipation factor of less than 0.05% at 25° C., acidity of less than 0.03 mg KOH/g, electrical conductivity of less than 1 pS/m at 25° C., a flash point of at least 250° C., and a pour point of at least −15° C.

2. The dielectric fluid of claim 1 wherein the fatty acid components of the which oleic acid triglyceride composition comprise less than 10% linoleic acid, less than 3% linolenic acid, less than 4% stearic acid, and less than 4% palmitic acid.

3. The dielectric fluid of claim 2 wherein said triglyceride composition is further characterized by the properties of:

a dielectric strength of at least 40 KV/100 mil gap, a dissipation factor of less than 0.02% at 25° C., acidity of less than 0.02 mg KOH/g, electrical conductivity of less than 0.25 pS/m at 25° C., a flash point of at least 300° C., and a pour point of at least −20° C.

4. The dielectric fluid of claim 1, wherein the one or more antioxidant compounds consists of tertiary butyl hydroquinone (TBHQ).

5. The dielectric fluid of claim 4, wherein the antioxidant additives further comprise a high molecular weight poly phenol antioxidant.

6. The dielectric fluid of claim 1, further comprising a synthetic ester.

7. An electrical apparatus comprising the electrical dielectric fluid of claim 1.

8. The electrical apparatus of claim 7 wherein said apparatus is an electrical transformer, an electrical capacitor or an electrical power cable.

9. An electrical apparatus comprising the dielectric fluid of claim 5.

10. A process for preparing the dielectric fluid of claim 1 comprising the steps of:

mixing 10 parts refined, bleached and deodorized high oleic acid triglyceride with 1 part or less by weight neutral clay to form a mixture, maintaining said mixture for at least about 20 minutes, filtering said mixture to remove said clay, and, adding the antioxidant additives to tile filtered mixture.

11. The process of claim 10 wherein said clay is 30/60 mesh size clay.

12. A process for preparing the dielectric fluid of claim 1, comprising:

heating the triglyceride composition;

contacting the heated triglyceride composition with clay;

filtering the triglyceride composition to remove clay particles therefrom; and adding the antioxidant additives to the filtered triglyceride composition.

13. The process of claim 12, further comprising:

lowering the temperature of the filtered triglyceride composition to 0° C. or below;

and filtering the triglyceride composition, thereby providing the triglyceride composition with a pour point below −25° C.

14. A dielectric fluid for an electrical device, said dielectric fluid comprising:

0.1 to 3% antioxidant additives comprising one or more antioxidant compounds selected from the group consisting of butylated hydroxy toluene (BHT), butylated hydroxy anisole (BHA), mono-tertiary butyl hydroquinone (TBHQ) and combinations thereof; and at least 75% high oleic acid vegetable oil selected from the group consisting of sunflower oil and canola oil, wherein said vegetable oil is purified by:

heating the vegetable oil;

contacting the heated vegetable oil with clay; and filtering the vegetable oil to remove clay particles therefrom, whereby said vegetable oil has the properties of:

a dielectric strength of at least 35 KV/100 mil gap, a dissipation factor of less than 0.05% at 25° C., acidity of less than 0.03 mg KOH/g, electrical conductivity of less than 1 pS/m at 25° C., a flash point of at least 250° C., and a pour point of at least −15° C.

15. The dielectric fluid of claim 14, wherein the vegetable oil comprises sunflower oil.

16. The dielectric fluid of claim 14, wherein the vegetable oil has fatty acid components of greater than 60% oleic acid.

17. The dielectric fluid of claim 16, wherein the vegetable oil has fatty acid components of at least 75% oleic acid.

18. The dielectric fluid of claim 17, wherein the antioxidant additives further comprise an alkylated diphenylamine.

19. The dielectric fluid of claim 14, wherein after the vegetable is purified, the vegetable is further processed by:

lowering the temperature of me filtered vegetable oil to 0° C. or below and filtering the vegetable oil, thereby providing the vegetable oil with a pour point below −25° C.

* * * * *